US006809694B2

(12) United States Patent
Webb et al.

(10) Patent No.: US 6,809,694 B2
(45) Date of Patent: Oct. 26, 2004

(54) ADJUSTABLE BEAMWIDTH AND AZIMUTH SCANNING ANTENNA WITH DIPOLE ELEMENTS

(75) Inventors: David B. Webb, Dallas, TX (US); Jonathon C. Veihl, McKinney, TX (US); Michael D. Thomas, Richardson, TX (US)

(73) Assignee: Andrew Corporation, Orland Park, IL (US)

( * ) Notice: Subject to any disclaimer, the term of this patent is extended or adjusted under 35 U.S.C. 154(b) by 9 days.

(21) Appl. No.: 10/400,886

(22) Filed: Mar. 27, 2003

(65) Prior Publication Data

US 2004/0061654 A1 Apr. 1, 2004

Related U.S. Application Data

(63) Continuation-in-part of application No. 10/255,747, filed on Sep. 26, 2002.

(51) Int. Cl.[7] ..... H01Q 19/06

(52) U.S. Cl. ..... 343/754; 343/890; 343/810; 343/816

(58) Field of Search ..... 343/757, 754, 343/753, 810, 816, 853, 890

(56) References Cited

U.S. PATENT DOCUMENTS

| | | | | |
|---|---|---|---|---|
| 2,897,460 | A | 7/1959 | LaRrosa | 353/33 |
| 2,961,620 | A | 11/1960 | Sommers | 333/31 |
| 2,961,622 | A | 11/1960 | Sommers | 333/82 |
| 3,005,168 | A | 10/1961 | Fye | 333/31 |
| 3,081,440 | A | 3/1963 | Augustine et al. | 333/31 |
| 3,114,121 | A | 12/1963 | Jordan | 333/29 |
| 3,139,597 | A | 6/1964 | French et al. | 333/31 |
| 3,181,091 | A | 4/1965 | Augustine et al. | 333/31 |
| 3,440,573 | A | 4/1969 | Butler | 333/31 |

(List continued on next page.)

FOREIGN PATENT DOCUMENTS

| | | |
|---|---|---|
| JP | 55-102901 | 8/1980 |

OTHER PUBLICATIONS

Jones, William T., "A Continuously Variable Dielectric Phase Shifter", *IEEE Transactions on Microwave Theory and Techniques*, Manuscript received Nov. 16, 1970; revised Feb. 11, 1971, (Aug. 1971), pp. 729–732.

*Primary Examiner*—Hoang V. Nguyen
(74) *Attorney, Agent, or Firm*—Wood, Herron & Evans, LLP

(57) ABSTRACT

An antenna system includes a plurality of cascading power dividers that work in conjunction with a plurality of mechanical phase shifters to vary a beamwidth and/or an azimuth scan angle of a beam that radiates from active columns. Each phase shifter has an independent remotely controlled drive and is directly electrically connected to a respective radiating column. The radiating columns include cross dipole antenna elements.

46 Claims, 4 Drawing Sheets

U.S. PATENT DOCUMENTS

| | | | | |
|---|---|---|---|---|
| 3,656,179 | A | 4/1972 | DeLoach | 333/31 |
| 3,742,400 | A | 6/1973 | Friend | 333/84 |
| 3,938,162 | A | 2/1976 | Schmidt | 343/840 |
| 3,946,396 | A | 3/1976 | Smith et al. | 343/753 |
| 3,999,182 | A | 12/1976 | Moeller et al. | 343/100 SA |
| 4,129,872 | A | 12/1978 | Toman | 343/768 |
| 4,178,581 | A | 12/1979 | Willey, Sr. | 343/108 |
| 4,314,378 | A | 2/1982 | Fowler et al. | 455/291 |
| 4,425,567 | A | 1/1984 | Tresselt | 343/373 |
| 4,602,227 | A | 7/1986 | Clark et al. | 333/109 |
| 4,626,858 | A | 12/1986 | Copeland | 342/374 |
| 4,916,454 | A | 4/1990 | Bull et al. | 342/373 |
| 5,214,436 | A | 5/1993 | Hannan | 343/705 |
| 5,281,974 | A | 1/1994 | Kuramoto et al. | 343/700 MS |
| 5,311,198 | A | 5/1994 | Sutton | 343/701 |
| 5,343,173 | A | 8/1994 | Balodis et al. | 333/126 |
| 5,499,005 | A | 3/1996 | Gu et al. | 333/246 |
| 5,504,466 | A | 4/1996 | Chan-Son-Lint et al. | 333/159 |
| 5,512,914 | A | 4/1996 | Hadzoglou et al. | 343/816 |
| 5,563,610 | A | 10/1996 | Reudink | 342/375 |
| 5,629,713 | A | 5/1997 | Mailandt et al. | 343/808 |
| 5,771,017 | A | 6/1998 | Dean et al. | 342/374 |
| 5,798,675 | A | 8/1998 | Drach | 333/161 |
| 5,801,600 | A | 9/1998 | Butland et al. | 333/127 |
| 5,832,389 | A | 11/1998 | Dent | 455/562 |
| H1773 | H | 1/1999 | Cheston et al. | 342/375 |
| 5,861,844 | A | 1/1999 | Gilmore et al. | 342/374 |
| 5,889,494 | A | 3/1999 | Reudink et al. | 342/373 |
| 5,905,462 | A | 5/1999 | Hampel et al. | 342/372 |
| 5,936,591 | A | 8/1999 | Yamasa et al. | 343/853 |
| 5,940,030 | A | 8/1999 | Hampel et al. | 343/372 |
| 5,943,016 | A | 8/1999 | Snyder, Jr. et al. | 343/700 MS |
| 5,949,303 | A | 9/1999 | Arvidsson et al. | 333/136 |
| 5,974,335 | A | 10/1999 | Talisa et al. | 505/210 |
| 6,037,912 | A | 3/2000 | DeMarre | 343/815 |
| 6,070,090 | A | 5/2000 | Feuerstein | 455/561 |
| 6,075,424 | A | 6/2000 | Hampel et al. | 333/161 |
| 6,088,003 | A | 7/2000 | Bassirat | 343/890 |
| 6,094,165 | A | 7/2000 | Smith | 342/373 |
| 6,094,166 | A | 7/2000 | Martek et al. | 342/374 |
| 6,097,267 | A | 8/2000 | Hampel | 233/128 |
| 6,172,654 | B1 | 1/2001 | Martek | 343/893 |
| 6,181,091 | B1 | 1/2001 | Heeren et al. | 318/138 |
| 6,198,455 | B1 | 3/2001 | Luh | 343/781 |
| 6,246,674 | B1 | 6/2001 | Feuerstein et al. | 370/334 |
| 6,268,828 | B1 | 7/2001 | Martek | 342/373 |
| 6,317,100 | B1 | 11/2001 | Elson et al. | 343/853 |
| 6,323,823 | B1 | 11/2001 | Wong et al. | 343/844 |
| 6,333,683 | B1 | 12/2001 | Hampel | 333/161 |
| 2004/0061653 | A1 * | 4/2004 | Webb et al. | 343/754 |

* cited by examiner

ADJUSTABLE BEAMWIDTH AND AZIMUTH SCANNING ANTENNA WITH DIPOLE ELEMENTS

CROSS REFERENCE TO RELATED APPLICATION

This is a continuation-in-part of presently pending U.S. application Ser. No. 10/255,747, entitled "Dynamically Variable Beamwidth and Variable Azimuth Scanning Antennas," which was filed by on Sep. 26, 2002, the disclosure of which is hereby incorporated by reference in its entirety.

FIELD OF THE INVENTION

This invention relates generally to antennas, and more particularly to a mechanism for dynamically varying the beamwidth and azimuth scan angle of such antennas.

BACKGROUND OF THE INVENTION

Antenna construction generally includes a plurality of antenna columns defining a signal beamwidth and azimuth scan angle. The beamwidth of an antenna may be modified by varying the phase of an electrical signal applied to the columns. Advancements in antenna technologies include providing each antenna column with an individually-coupled, mechanical phase shifter. Systems having a phase shifter dedicated to each column of an antenna allow improved beamwidth and azimuth scan angle control.

While antenna configurations having individually-coupled phase shifters provide increased wave propagation control, still greater beamwidth and azimuth scan angle variability is desired. Additionally, an individually-coupled phase shifter configuration may fail to provide sufficient control for certain signal diversity applications, such as where dual dipole elements are desired. Signal diversity generally involves separating signals for subsequent processing. For instance, two signals having different polarizations may be combined upon transmittal so that their aggregate signal strength is sufficient to allow the composite signal to reach respectively polarized antenna columns.

Antennas having dual dipole elements allow a single column to receive/transmit both polarizations, avoiding maintenance, space and aesthetic drawbacks associated with greater numbers of single pole antennas. However, diversity benefits associated with dual dipole elements may remain unrealized in conjunction with the individually-coupled phase shifter configuration incorporated herein, which would facilitate improved propagation control in only one of the two polarizations.

Consequently, there is a need to provide wider dynamic wave propagation control. Further improvements are also possible where each column of an antenna includes multiple poles.

BRIEF DESCRIPTION OF THE DRAWINGS

The accompanying drawings, which are incorporated in and constitute a part of this specification, illustrate embodiments of the invention and, together with the detailed description given below, serve to explain the principles of the invention.

DETAILED DESCRIPTION OF THE DRAWINGS

Figure 1:
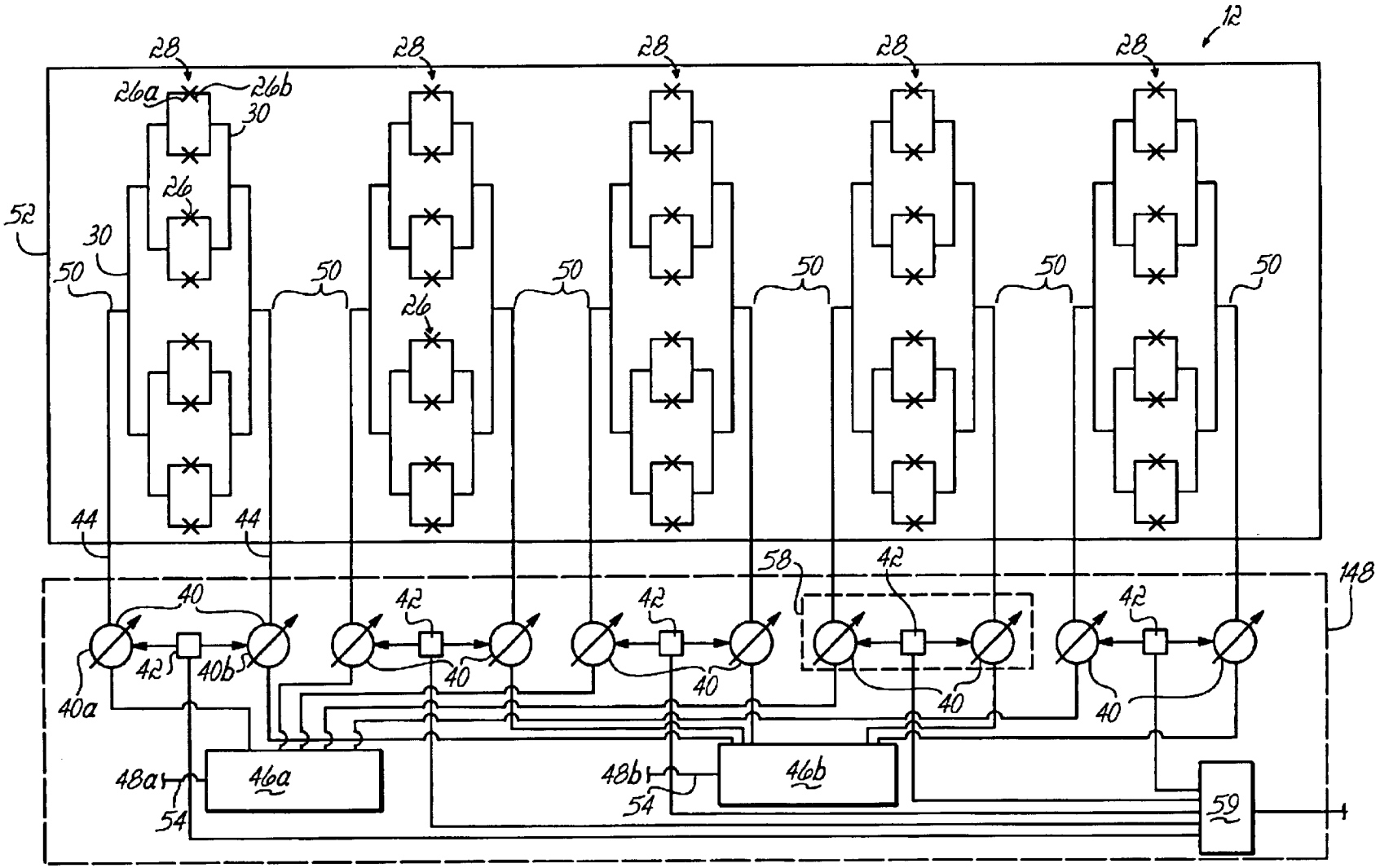
FIG. 1 is a schematic diagram of the dynamically variable beamwidth and/or variable azimuth scan angle antenna for purposes of explaining the principles of the present invention.

FIG. 1 shows an exemplary antenna system 10 for purposes of explaining the principles of the present invention. The system includes at least one dynamically variable beamwidth and variable scan angle antenna 12. The antenna 12, in turn, comprises a plurality of spaced-apart active radiating columns 28. Where desired, each column 28 includes a dual dipole element 26 having respective dipoles 26*a* and 26*b*.

As shown in FIG. 1, each column 28 may electrically couple to a respective pair 40 of phase shifters 40*a,b* of a plurality of continuously adjustable mechanical phase shifters. As explained below in greater detail, phase shifter 40*a* of a respective phase shifter pair 40 may connect to a first dipole 26*a* of each dual dipole element 26 of a radiating column 28, and phase shifter 40*b* of the phase shifter pair may connect to a second dipole 26*b* of each dual dipole element 26. As such, each phase shifter 40*a,b* is positioned so as to affect a respective polarization of the signal propagating from each column 28.

More particularly, each phase shifter 40*a,b* is positioned between a column signal node 50 and a feed node 54 so as to affect the beamwidth and/or azimuth scan angle of the signal through phase variance. To further facilitate signal pattern control, each phase shifter pair 40 includes an independently and remotely controlled drive 42. In the embodiment, the phase shifter pair 40 of a respective column 28 couples to a common drive 42 for material and operating considerations. For instance, such common control may simplify user control of wave propagation.

The beamwidth and the azimuth scan angle are correlated to phase shifts and/or power distributions accomplished between the respective column nodes 50 and the feed node 54. In accordance with the principles of the present invention and as will be described hereinafter, the beamwidth and/or azimuth scan angle may be varied such as in response to signal from a control station so as to broaden or narrow the width of the beam and/or move the center of the beam left or right.

To that end, the phase shifters 40*a,b* are independently operable to vary the phase shift, i.e., the phase of an electrical signal, between the respective column signal nodes 50 and respective feed nodes 54, to thereby vary the beamwidth and/or azimuth scan angle of the beam defined by the plurality of active radiating columns 28.

A plurality of cascading power dividers contained within an azimuth feed network 46*a* and 46*b* may work in tandem with or separately from the phase shifters 40*a,b* to similarly affect the beamwidth and/or azimuth scan angle. That is, the power dividers of one embodiment are positioned between the column signal node 50 and the feed node 54. Such positioning allows the power dividers to affect the beamwidth and/or azimuth scan angle of the signal through power variance. To facilitate such signal pattern control, many or all of the power dividers may include an independently controlled drive. Where desired, the drive control of the power dividers is remotely controlled for operability and performance reasons.

As shown in FIG. 1 the dual dipole elements 26 within each respective column 28 are electromagnetically coupled, such as through elevation reed networks comprising stripline or microstrip conductors, as shown at reference numeral 39 on circuit board 52 in FIG. 1. The dual dipole elements 26 may also mount on the circuit board 52. Alternatively, the dual dipole elements 26 within a column 28 may be coupled using air stripline and/or one or more power dividers having associated cabling (all of which are not shown), eliminating the need for a circuit board. Although the dynamically variable beamwidth antenna 12 shown in FIG. 1 includes five columns 28, each column 28 having ten dual dipole elements 26, embodiments of the present invention may be configured using any desired number of columns and elements without departing from the spirit of the present invention. Moreover, while dual dipole elements have particular application within certain embodiments of the present invention, one of skill in the art will appreciate that other embodiments may include any radiating element, to include single or multi-pole elements.

With further reference to FIG. 1, electrically associated with each active radiating column 28 is a respective pair of continuously adjustable mechanical phase shifters 40*a,b*. Each mechanical phase shifter pair 40 typically couples to a respective, independent and remotely controlled drive 42. Each respective mechanical phase shifter 40*a,b* of a pair 40 is directly electrically connected, such as by coaxial cables 44 and/or striplines 30, to the dual dipole elements 26 of a respective active radiating column 28. Such direct electrical connections define column signal nodes 50.

In one embodiment, respective pairs of phase shifters correlate to different polarizations (e.g., plus and minus 45 degrees) and couple to respective radiating columns of the antenna. The beamwidth and/or azimuth scan angle of each beam may also be adjusted remote from the antenna where desired via a remote phase shifter interface.

Each mechanical phase shifter 40*a,b* may also electrically couple to a plurality of power dividers included within a respective azimuth feed network 46, which defines a respective feed node 54. Thus, as illustrated in the schematic diagram of FIG. 1, the mechanical phase shifters 40*a,b* couple to intermediate column signal nodes 50 and feed node 54. A radio frequency (RF) connection 48 couples signals to and from feed node 54 as will be readily appreciated. Mechanical phase shifters 40*a,b* may be adjusted independently to vary the phase of the signal emanating from columns 28.

In addition to the plurality of power dividers, an exemplary azimuth feed network 46 may include a circuit board in the form of traces, associated cabling, and/or other structures to provide a serial or corporate feed, as will be appreciated by those skilled in the art. The plurality of power dividers of the azimuth feed network 46 may apportion power input at nodes 54 among the active radiating columns 28 via the phase shifters 40*a,b* to vary the beamwidth and azimuth scan angle of a signal radiating from the antenna 12. Conversely, in receiving a signal, the plurality of power dividers of each azimuth feed network 46 may combine power incident on elements 26 in the radiating columns 28 to be received at a respective feed node 54.

An exemplary power divider may comprise one or more couplers, as well as an inline phase delay device. One of skill in the art should appreciate that a reflective-type phase delay device may alternatively and/or additionally be used. Where desired, each power divider 41 may include a pair of hybrid directional couplers. As in known in the art, a hybrid directional coupler is a four port electromagnetic device that is configured to provide an output that is proportional solely to power incident from a source. For a given bandwidth, a hybrid directional coupler will divide the incident power from a source at one port between two other ports at quadrature phase. The relative power at each other port with respect to the incident power will be known for a given set of impedances, each coupled to a port of the device.

Quadrature hybrid directional couplers are commonly used in communications equipment. Such couplers allow a sample of a communications signal input at an input port and output at an output or "direct" port, to be taken from the signal at third or "coupled" port. No signal emerges from the fourth or "isolated" port. When appropriately designed, a directional coupler may discern between a signal input at the input port and signal input at the direct port. Such ability to discern is particularly useful when, for example, a coupler is coupled intermediate an RF amplifier and an antenna. In such a configuration, the output of the RF amplifier may be monitored independently from that of a signal reflected from a mismatched antenna. Moreover, such a monitored signal may be used to control the gain, e.g., automatic gain control (AGC), or reduce the distortion of the RF amplifier. In any case, a suitable power divider for purposes of this specification may comprise any device capable of apportioning and/or combining power as appropriate.

Figure 2:
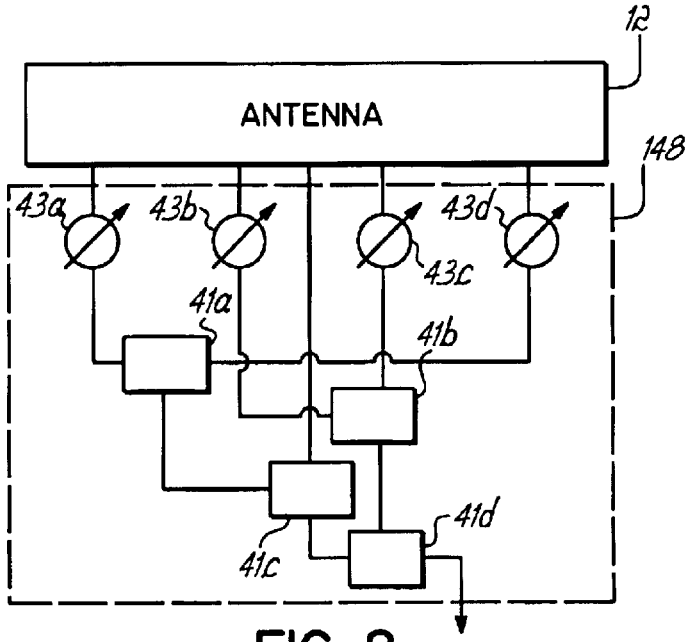
FIG. 2 is a block diagram of an azimuth scanning network suited for explaining the principles of the present invention.

FIG. 2 shows a power divider configuration 148 suited for explaining the principles of the present invention. As illustrated, a configuration of power dividers 41 similar to that of FIG. 2 could be included within each of the azimuth feed networks 46 of FIG. 2 to provide beamwidth and azimuth scan angle adjustment. Thus, the power divider configuration 148 may couple to each column 28. For instance, the configuration may couple to a mechanical phase shifter 43*a–d* of each (column 28) phase shifter pair that corresponds to a specific polarization of a dual dipole element 26.

As shown in FIG. 2, one or more of the power dividers 41 may alternatively couple to a respective dual dipole element 26 without first coupling to a variable phase shifter 43*a–d*. Implementation of such a configuration may be particularly applicable where the relative phase of the respective dual dipole element 26 remains constant. Such a scenario is discussed below in greater detail.

In any case, changes in power delivered to respective phase shifters 43*a–d* may bring about variation in beamwidth and azimuth scan angle for the specific polarization associated with the respective phase shifters 43*a–d*. Where single dipole elements 26 are alternatively used, one of skill in the art will appreciate that a single configuration/azimuth feed network 46 may adequately service all columns. Moreover, an embodiment of the present invention may include more or fewer power dividers 41 while remaining in accordance with the principles of the present invention.

Turning more particularly to FIG. 2, a first power divider 41*a* couples to respective antenna elements of an antenna 12 via respective phase shifters 42. As discussed herein, a suitable antenna element of the antenna 12 may comprise any device configured to receive and/or transmit electromagnetic radiation, to include the above discussed dual dipole elements of the antenna 12. In the context of FIG. 1, each antenna element 26 may be included within respective radiating columns 28.

As shown in FIG. 2, a second power divider 41*b* couples to third and fourth antenna elements, respectively, of the antenna 12, while a third power divider 41*c* couples to both the first power divider 41*a* and a fifth antenna element of the antenna's plurality of antenna elements 26. Finally, a fourth power divider 41*d* completes the distributed configuration 148 by coupling to both the second and third power dividers, 41*b* and *c*. By adjusting the power distribution setting of one or all of the power dividers 41 in the azimuth feed network 46, a user may modify the beamwidth and/or azimuth scan angle of a signal propagating from the antenna 12.

Where desired, the distributed power dividers 41 of the azimuth feed network 46 may couple to the antenna 12 via mechanical phase shifters 40*a,b* as shown in FIG. 1. Mechanical phase shifters 40*a,b* and their drives mount directly adjacent their respective radiating column 28 of antenna 12. Such mounting furthers the utility of the azimuth feed networks 46 in antenna 12, allowing a single RF connection 48 per azimuth feed network 46 to antenna 12, thereby reducing the number of cables that must traverse tower 14.

Each drive 42 is independently and remotely controlled using signal(s) coupled through a cable, an optical link, an optical fiber, or a radio signal as indicated at reference numeral 24. As shown in FIG. 1, each drive 42 may have its own respective signal. Using conventional means of addressing, signals 24 may be multiplexed as provided by interface 59. As discussed herein, a common drive 42 may service both phase shifters 40*a,b* of a respective phase shifter pair 40. Such mutual coupling may simplify signal adjustment processes for a user where desired.

As such, each mechanical phase shifter 40*a,b* may be used to vary the phase or delay of a signal between feed node 54 and the respective column node 50 for a given polarization. Further, phase shifters 40*a,b* may also be used to vary or stagger the phase between the respective nodes 50, thereby varying the phase between the radiating columns 28. The differences in phase between the radiating columns 28, associated with transmission and reception of signals from antenna 12 determines the beamwidth and/or azimuth scan angle of antenna 12.

Generally, in varying the beamwidth of such an antenna 12, a phase delay will be added to or subtracted from the radiating columns 28 such that a greater amount of change in delay is applied to the outer most columns. A mathematical equation may be derived that relates the phase differences between the radiating columns 28 in varying the beamwidth. One such equation may be a second order linear equation, or a quadratic equation.

Similarly, in varying the azimuth scan angle, a phase delay may be added to one end of the columns 28 in the plurality of columns while a phase delay may be subtracted from those columns at the other end. One mathematical equation that relates the phase differences between the radiating columns 28 in varying the azimuth scan angle is a first order linear equation. Those skilled in the art will appreciate that other equations, such as higher order polynomial equations, relating the differences in phase between the radiating columns 28 may also be used and/or derived. Moreover, those skilled in the art will appreciate that a combination of equations each relating phase differences between the radiating columns 28, such as a linear and a quadratic equation, may be used in varying both beamwidth and azimuth scan angle.

The beamwidth of such an antenna may be varied from approximately 30° to approximately 180° for each beam, depending on the arrangement of the columns 28, for example, while the azimuth scan angle may be varied by approximately +/−50° for each beam. The ability to vary the azimuth scan angle depends on the beamwidth selected. For example, if a beamwidth of 40° is selected, the azimuth scan angle may be varied +/−50°. However, if a beamwidth of 90° is selected, the azimuth scan angle may be limited such as to +/−40°. Those skilled in the art will appreciate that other beamwidths may be selected that correspondingly affect the range of variability of the azimuth scan angle.

Thus, according to the principles of the present invention, and as illustrated in FIG. 1, the phase shifters 40*a,b* are independently and remotely operable to vary the beamwidth and/or azimuth scan angle of antenna 12 (in tandem or independent of the adjustable power dividers 41). Moreover, such an adjustment in beamwidth and/or azimuth scan angle is possible while antenna 12 is in operation, i.e., dynamically.

Since the difference in phase between columns 28 affects the beamwidth and/or azimuth scan angle of such an antenna, one or more of the columns 28 may be fixed in phase with respect to the signal transmitted by or received using the antenna 12, thereby varying the phase of only those remaining columns 28. For example and as shown in FIG. 1, a pair 40 of phase shifters 40*a,b* along with their associated drive 42 and control signal 24, could be eliminated as indicated by connection 58 (shown in dashed line). A number of such connections 58 would effectively short nodes 50 and 54, such that the columns 28 outnumber phase shifter pairs, or even phase shifters 41.

The remaining phase shifters 41 may then vary the signals at nodes 50 with respect to the signal at the shorted nodes 58 to vary the beamwidth and/or azimuth scan angle of antenna 12. Elimination of a phase shifter 41 and its associated drive reduces the cost of the antenna 12. Those skilled in the art will recognize that other embodiments of the present invention may be constructed using differing numbers of columns 28, phase shifters 40*a,b* and/or power dividers 41.

As discussed herein, exemplary mechanical phase shifters 40*a,b* may be linear, reflective-type or rotary. Either type of phase shifter may be coupled to a drive 42, such as a motor or other suitable means, to move a piece of dielectric material relative to a conductor within the phase shifter, to thereby vary the insertion phase of a signal between input and output ports of the device.

Figure 3:
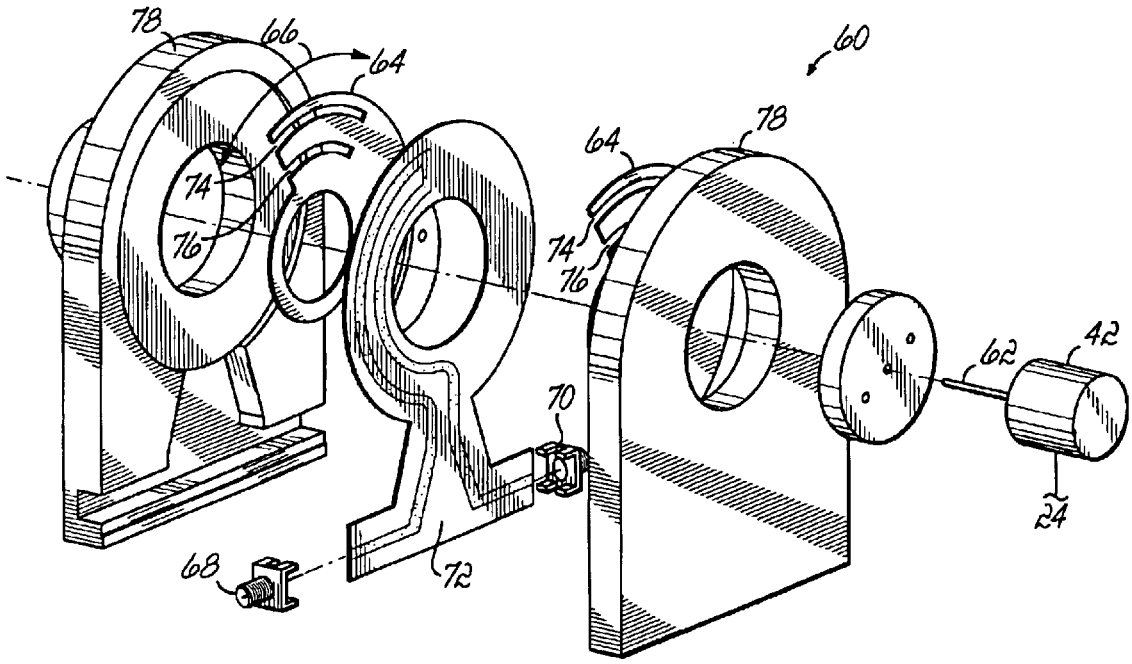
FIG. 3 is an exploded view of an exemplary rotary mechanical phase shifter including a drive.

Referring to FIG. 3, an exploded view of an exemplary rotary mechanical phase shifter 60 including a drive, or motor, 42 is illustrated. Drive 42 is responsive to a control signal 24 and includes a shaft 62. Shaft 62 may be coupled directly to the mechanical phase shifter 60, as shown in FIG. 3, or through a gearbox, pulleys, etc. (not shown). Shaft 62 is coupled to a high dielectric constant material 64 that is rotated, as indicated by arrow 66, in a housing 78.

Rotary mechanical phase shifter 60 varies the phase shift between input and output ports 68, 70 by rotating 66 high dielectric constant material 64 on both sides of stripline center conductor 72. The high dielectric constant material 64 has a slower propagation constant than air, and thus increases electrical delay of a signal carried by conductor 72. Slots 74, 76 provide a gradient in the dielectric constant. Alternatively, a plurality of holes or other apertures in the high dielectric constant material 64 may be used to provide a gradient in the dielectric constant. The amount of delay, or phase shift, is determined by the relative length of conductor 72 covered above and/or below by the high dielectric constant material 64. Thus, the rotation 66 of high dielectric constant material 64 relative to conductor 72 varies the phase of a signal between ports 68 and 70 of the phase shifter 60. Housing 78 may be constructed using aluminum or some other suitably rigid material.

Another example of a rotary mechanical phase shifter may be found in an article entitled, "A Continuously Variable Dielectric Phase Shifter" by William T. Joines, *IEEE Transactions on Microwave Theory and Techniques,* August 1971, the disclosure of which is incorporated herein by reference in its entirety.

Figure 4:
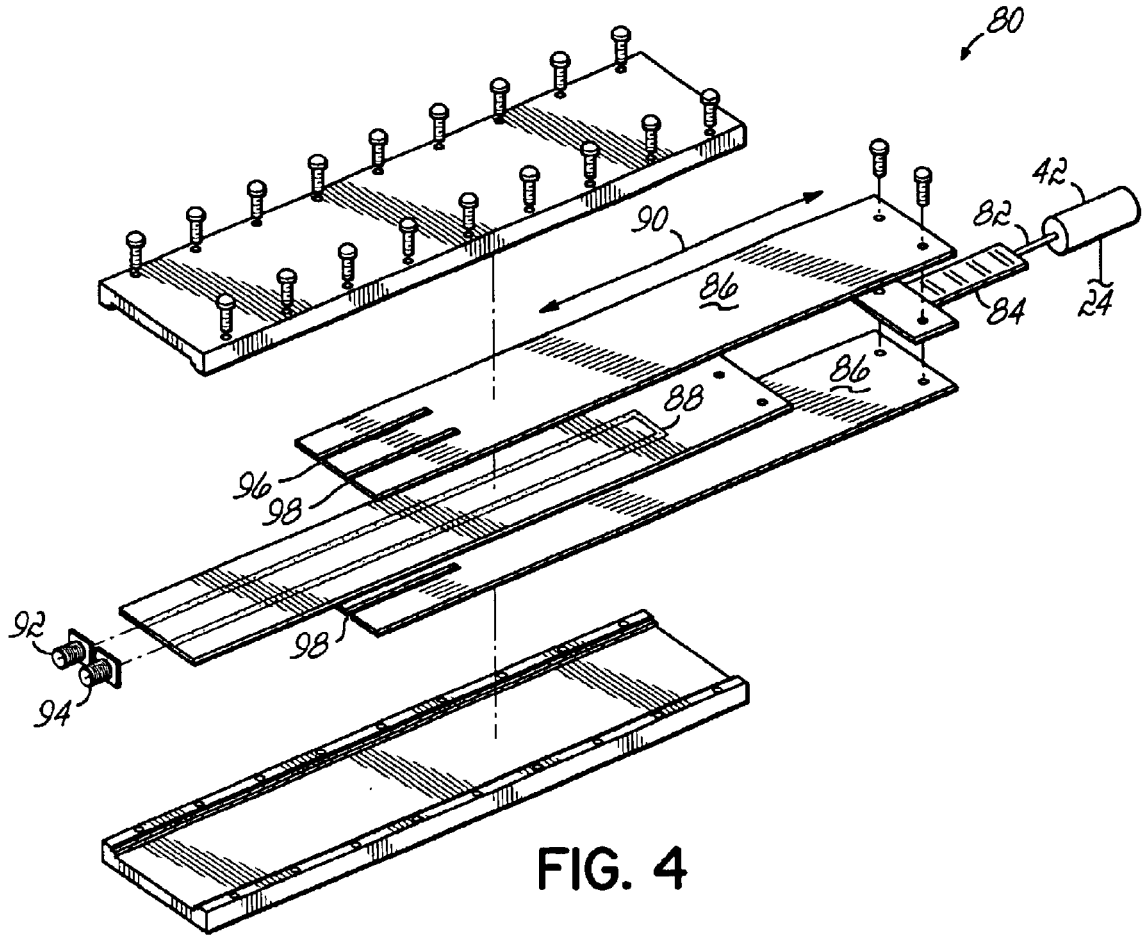
FIG. 4 is an exploded view of an exemplary linear mechanical phase shifter including a drive.

Referring to FIG. 4, an exploded view of an exemplary linear mechanical phase shifter 80 is illustrated. Linear mechanical phase shifter 80 couples to a drive, such as a motor 42, having a shaft 82. Shaft 82 couples through a mechanism, such as a worm gear 84, to slab(s) 86 of a high dielectric constant material within the phase shifter 80. In response to signal 24, drive 42, through shaft 82 and worm gear 84, moves high dielectric constant material 86 linearly relative to a conductor 88, as indicated at by arrow 90.

The high dielectric constant material 86 has a slower propagation constant than air, and thus increases the electrical delay of a signal carried by conductor 88. Slots 96, 98 provide a gradient in the dielectric constant. The amount of delay, or phase shift, is controlled by the relative length of the conductor 88 that is covered, above and/or below, by the high dielectric constant material 86. Thus, the linear position of the high dielectric constant material 86 relative to conductor 88 determines the phase of a signal between ports 92 and 94 of the phase shifter 80.

Another example of linear phase shifter may be found in U.S. Pat. No. 3,440,573, the disclosure of which is incorporated herein by reference in its entirety. Yet another example of a linear phase shifter may be found in U.S. Pat. No. 6,075,424, the disclosure of which is also incorporated herein by reference in its entirety.

In addition to the phase relationships between the columns, the number of columns, the spacing between the columns, and the relative position of the columns in an antenna may determine the ability to vary beamwidth and/or azimuth scan angle as desired.

Figure 5:
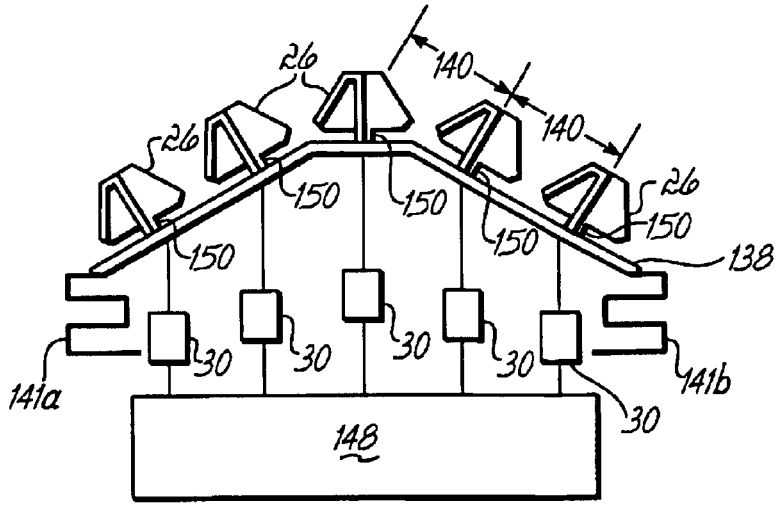
FIG. 5 is a top view of an antenna having an irregular or linearly segmented column arrangement.
Figure 6:
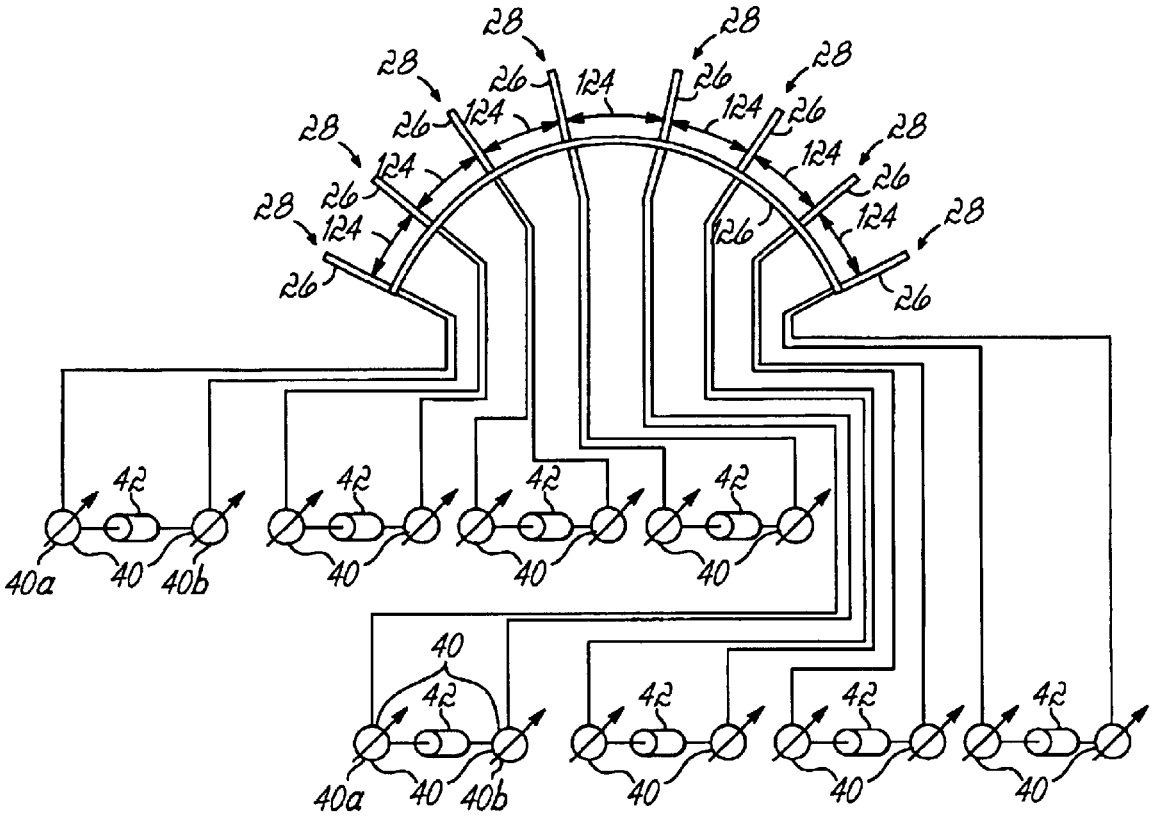
FIG. 6 is a top view of an antenna having a curvilinear column arrangement.
Figure 7:
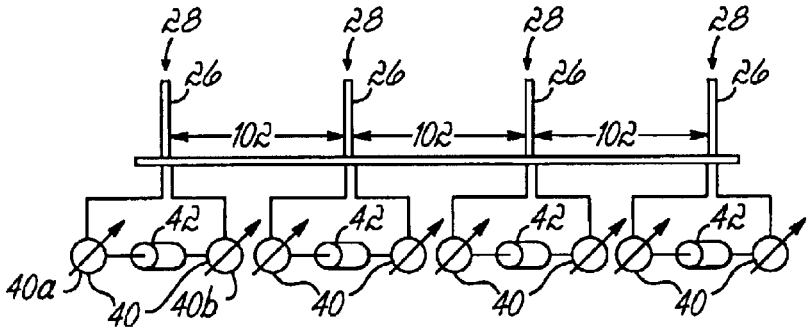
FIG. 7 is a top view of an antenna having a linear column arrangement.

FIGS. 5–7 illustrate top views of three antennas having particular column arrangements suited for explaining the principles of the present invention. Those skilled in the art will appreciate that the present invention is not limited to any one of these arrangements, they are merely shown by way of example.

More particularly, FIG. 5 shows an antenna having an irregular or linearly segmented arrangement of five active radiating columns 28. Each column 28 contains a plurality of dual dipole elements 26. The dual dipole elements 26 in each radiating column 28 comprise conductive elements on one or more circuit boards 150 in each column 28. The circuit boards 150 mount to one or more sheet metal reflectors 138. Where desired, the reflectors 138 include one or more holes or apertures (not shown) for electrically coupling to dual dipole elements 26 in radiating columns 28.

The dual dipole elements 26 within each active radiating column 28 are electromagnetically coupled using elevation feed networks 30 as described in conjunction with FIG. 1. As such, the elevation feed networks are located behind the reflectors 138. For example, if ten active radiating elements 26 were used per active radiating column 28, then ten cables from each elevation feed network 30 may be used to electromagnetically couple the dual dipole elements 26 within each column 28.

Alternatively, the dual dipole elements 26 within each respective column 28 may be electromagnetically coupled using a combination of stripline or microstrip conductors located on circuit boards 150 and a plurality of remotely controlled, adjustable power dividers having associated cabling, located behind reflectors 138. As discussed herein, power variation provided by the adjustable power dividers positioned within block 148 allows users to tailor the beamwidth and azimuth scan angle of the signal pattern. Antenna includes a plurality of mechanical phase shifters 40*a,b* and power dividers 41 as previously described in conjunction with FIG. 1 and as indicted by reference numeral 148 in both FIGS. 1 and 5.

Columns 28 may be substantially equally spaced (by a distance 140, typically at about 0.4 wavelength intervals), columns 28 being arranged in substantially a first plane 142. Columns 28 are substantially equally spaced 140 from each other. The columns 28 are further set back a distance 144 and 145, respectfully, from the first plane 142. Such an irregular or linearly segmented arrangement allows beam 32 broadening, typically associated with an arcuate, curvilinear or cylindrical arrangement as discussed below in detail, while reducing the mutual coupling between adjacent dual dipole elements in adjacent columns.

As shown in FIG. 5, exemplary dual dipole elements 26 may bow, angle, or "droop," inwardly. This bowed feature may minimize space required by the elements, allowing for optimum space efficiencies. The bowed configuration of the elements may further offer advantageous propagation characteristics of their own. For instance, the bowed shape may affect the propagation pattern of the signal transmitted from the columns in a predictable and desirable manner, such as beamwidth equalization. While the dual dipole elements 26 of FIG. 5 have dual slant polarizations, other embodiments that are consistent with the invention could alternatively use any orthogonal polarization. Moreover, one of skill in the art will appreciate that the choke 141*a* and 141*b* and ground plane structures of the antenna 12, as well as the relative shape of each element 26 may be modified to meet specific application requirements. For example, the choke 141*a* and 141*b* and ground planes may be optimized to mitigate radiation from front to back.

Referring to FIG. 6, an antenna having an arcuate, curvilinear or cylindrical arrangement of active radiating columns 28 is illustrated. The antenna comprises a plurality of dual dipole elements 26 arranged into the eight substantially equally spaced (by a distance 124) active radiating columns 28 by mounting the elements 26 to a similarly arcuate, curvilinear or cylindrical curved reflector 126 having a stripline or microstrip traces (not shown) for coupling the respective dual dipole elements 26 with each column 28. The antenna further comprises pairs of continuously adjustable mechanical phase shifters 40*a,b*, each coupled to a respective independently remotely controlled drive 42 and a plurality of power dividers 46. In operation, control signals 24 actuate drives 42 adjusting the mechanical phase shifters 40*a,b* so as to dynamically vary the beamwidth and/or azimuth scan angle of antenna as described hereinbefore. Likewise, the plurality of power dividers 46 may function to vary power delivered to each phase shifter. In this manner, the power variance further functions to vary the beamwidth and/or azimuth scan angle of the antenna.

The arcuate, curvilinear or cylindrical arrangement of active radiating columns 28*a–h* shown in FIG. 6 may allow for wider beam broadening than that of a linear arrangement described below. The spacing 124 of columns 28, such as advantageously on substantially quarter (0.25) wavelength intervals of the center frequency of the antenna, reduces the antenna side lobes at the expense of increased mutual coupling between adjacent dual dipole elements 26 in adjacent columns 28.

Referring to FIG. 7, an antenna having a flat, planar, or linear arrangement of columns is illustrated. The antenna includes four substantially equally spaced (by a distance 102) active radiating columns 28, each containing a plurality of dual dipole elements 26 mounted to a circuit board, or reflector, 104. The dual dipole elements 26 within each respective column 28 are coupled using stripline, microstrip, or air stripline (none of which are shown), as described hereinabove. The active radiating columns 28 are directly electrically connected to respective pairs 40 of continuously adjustable mechanical phase shifters 40*a,b*, each pair 40 coupled to a respective independently remotely controlled drive 42 (although at least one of the phase shifters 40*a,b* may be eliminated as discussed earlier in connection with FIG. 2). Each phase shifter 40*a,b* of the illustrated embodiment of FIG. 8 also couples to a network of distributed power dividers 46. The power dividers 46 may vary the power supplied to respective phase shifters, thereby altering the beamwidth and/or scan angle of the antenna system.

The beamwidth and/or scan angle may be further configured via control signals 24 that actuate the drives 42. The drives are configured to adjust the mechanical phase shifters 40*a,b* so as to dynamically vary the beamwidth and/or azimuth scan angle of antenna independently from or in tandem with the power dividers 46 as described hereinbefore.

One of skill in the art will appreciate that while the operation of the phase shifters and power dividers may complement each other to synergistically produce superior signal pattern control, different embodiments may include and/or use only one of variable phase shifters or power dividers as described herein to vary the beamwidth and/or scan angle. Similarly, while the use of dual dipole elements provides particular utility in certain applications may use single pole radiating elements.

Thus, in operation, each column 28 of the antenna system includes dual dipole elements 26. Thus, each column 28 accommodates two polarizations useful in signal diversity applications. To fully obtain the benefits of each polarization, the antenna system couples two independent phase shifters to each column 28. In so doing, a separate phase shifter may adjust the bandwidth and/or azimuth scan angle for each, diversely polarized signal. As discussed below, each pair of phase shifters corresponding to respective column polarizations may gang together at a common drive 42 for operating considerations. Alternatively, separate drives may control each phase shifter 40*a,b*, while still providing signal diversity.

To achieve greater wave propagation control for each polarized signal, an embodiment of the present invention may capitalize on the independent nature of each phase shifter 40*a,b* by combining them with a cascading series of adjustable power dividers. As shown in FIG. 2, a network of power dividers 41 may couple to each phase shifter 40*a,b* associated with a particular polarization. As such, two separate networks of power dividers 41 may vary energy delivered to the antenna 12 in such a manner as to further affect the beamwidth and or azimuth scan angle of each polarized signal. The power dividers 41 may thus work separately or in concert with the phase shifters 40*a,b* to provide greater wave propagation control.

The radiating columns 28 may include dual dipole antenna elements 26 as discussed below in greater detail. In one respect, the dual dipole antenna elements 26 provide signal diversity. That is, the dual dipole antenna elements allow both simultaneously transmitted signals to be received by the same, dual dipole element. This configuration obviates the above discussed requirement of prior art systems for multiple antennas. In so doing, an embodiment of the present invention can receive, transmit and dynamically configure signals without burdening users with many space and maintenance complications that plague conventional antenna systems.

By virtue of the foregoing, there is thus provided a dynamically variable beamwidth and/or variable azimuth scanning angle antenna that relies on the principle of phase shifters to adjust the beamwidth and/or azimuth scan angle with the advantages of both the mechanical phase shifters and the smart antenna, but without their respective drawbacks.

While the present invention has been illustrated by the description of embodiments thereof, and while the embodiments have been described in considerable detail, it is not the intention of applicants to restrict or in any way limit the scope of the appended claims to such detail. Additional advantages and modifications will readily appear to those skilled in the art. It will be understood that an antenna for purposes of this specification may be utilized as a transmit and/or receive antenna independently or simultaneously, thereby broadening or narrowing the transmit or receive beamwidth and/or steering the beam center accordingly as desired. Further, the present invention is not limited in the type of radiating elements used. Any type of radiating elements may be used, as appropriate. The invention is also not limited in the number of rows of radiating elements, nor does it necessitate rows, per se. The invention may also be used with or without antenna downtilt, either mechanical or electrical.

Moreover, the azimuth distribution network described herein may incorporate the ability to vary the amplitude of a signal at the respective column signal nodes furthering the ability to vary the beamwidth and/or azimuth scan angle. Still further, although the number of columns in relation to phase shifter pairs and/or power dividers are disclosed above, other relationships can be realized in accordance with the principles of the present invention. Those skilled in the art will also appreciate that an antenna in accordance with the present invention may be mounted in any location and is not limited to those mounting locations described herein. The invention in its broader aspects is therefore not limited to the specific details, representative apparatus and method, and illustrative examples shown and described. Accordingly, departures may be made from such details without departing from the spirit and scope of applicants' general inventive concept.

What is claimed is:

1. A dynamically variable beamwidth and variable azimuth scanning antenna comprising:

a plurality of spaced-apart, active radiating columns each including a dual dipole element, the plurality of radiating columns collectively defining both first and second beamwidths, as well as first and second azimuth scan angles corresponding to respective first and second polarizations of the dual dipole elements, wherein the respective beamwidths and azimuth scan angles correlate to phase shifts between a respective feed node and each radiating column of the plurality of columns; and a plurality of continuously adjustable, remotely controlled mechanical phase shifters grouped in pairs, one pair per each column, each phase shifter of a phase shifter pair correlating to one of the respective first and second polarizations and being juxtaposed between a respective radiating column and the respective feed node, wherein each phase shifter of the phase shifter pair is independently operable to vary the phase shift for the one respective polarization between each respective radiating column of the plurality of radiating columns and the feed node to thereby vary at least one of the respective beamwidths and the respective azimuth scan angles defined by the plurality of active radiating columns.

2. The antenna of claim 1, the first polarization being orthogonal to the second polarization.

3. The antenna of claim 1, wherein the phase shifter pair includes a common drive.

4. The antenna of claim 1, wherein the dual dipole element angles inwardly.

5. The antenna of claim 1, wherein the plurality of radiating columns outnumber the plurality of phase shifters.

6. The antenna of claim 1, wherein the plurality of radiating columns equal the plurality of phase shifters in number.

7. The antenna of claim 1, wherein the plurality of radiating columns comprise five radiating columns.

8. The antenna of claim 1, wherein the active radiating columns are spaced apart in a linear pattern.

9. The antenna of claim 1, wherein the active radiating columns are spaced apart in a linearly segmented pattern.

10. The antenna of claim 9, wherein the active radiating columns are spaced apart at approximately 0.4 wavelength intervals.

11. The antenna of claim 1, wherein the active radiating columns are spaced apart in a curvilinear pattern.

12. The antenna of claim 1, wherein the active radiating columns are spaced apart at substantially quarter wavelength intervals.

13. The antenna of claim 1, wherein the mechanical phase shifters are linear phase shifters.

14. The antenna of claim 1, wherein the mechanical phase shifters include at least one of a rotary and a reflective-type phase shifter.

15. The antenna of claim 1, further comprising a control station, the control station electronically communicating with the antenna using signals, each signal associated with a respective independently controlled drive and used to actuate the drive, thereby adjusting the phase shifter, and vary the beamwidth of the antenna.

16. A dynamically variable beamwidth and variable azimuth scanning antenna comprising:

a plurality of spaced-apart active radiating columns each having a respective column signal node, the columns collectively defining a beamwidth and an azimuth scan angle correlated to phase shifts and power levels between the respective column signal nodes and a feed node;

a plurality of continuously adjustable mechanical phase shifters grouped in pairs, one pair per column, each phase shifter of a phase shifter pair having an independent remotely controlled drive and being directly electrically connected to a respective radiating column between the column signal node thereof and the feed node, the phase shifters being independently operable to vary the phase shift between the respective column signal nodes and the feed node to thereby vary at least one of the beamwidth and the azimuth scan angles defined by the plurality of active radiating columns; and a plurality of adjustable power dividers electrically connected to the plurality of spaced-apart active radiating columns, the power dividers being operable to vary the power levels between respective column signal nodes and the feed node to thereby vary at least one of the beamwidth and the azimuth scan angles defined by the plurality of active radiating columns.

17. The antenna of claim 16, wherein the plurality of power dividers are isolated.

18. The antenna of claim 16, wherein the plurality of radiating columns include a dual dipole element.

19. The antenna of claim 16, wherein the plurality of radiating columns outnumber the plurality of phase shifters.

20. The antenna of claim 16, wherein the plurality of radiating columns equal the plurality of phase shifters in number.

21. A dynamically variable beamwidth and variable azimuth scanning antenna comprising:

a plurality of antenna elements, the antenna elements configured to receive and transmit electromagnetic radiation;

a first power divider, the first power divider having a receive port and first and second transmit ports, wherein the first and second transmit ports of the first power divider are coupled to first and second antenna elements, respectively, of the plurality of antenna elements;

a second power divider, the second power divider having a receive port and first and second transmit ports, wherein the first and second transmit ports of the second power divider are coupled to third and fourth antenna elements, respectively, of the plurality of antenna elements;

a third power divider, the third power divider having a receive port and first and second transmit ports, wherein the first transmit port of the third power divider is coupled to the receive port of the first power divider and the second transmit port of the third power divider is coupled to a fifth antenna element of the plurality of antenna elements; and a fourth power divider, the fourth power divider having a receive port and first and second transmit ports, wherein the first transmit port of the fourth power divider is coupled to the receive port of the third power divider, the second transmit port of the fourth power divider is coupled to the receive port of the second power divider and the receive port is coupled to a feed node.

22. The antenna of claim 21, wherein at least one of the power dividers is isolated.

23. The antenna of claim 21, further comprising a plurality of continuously adjustable mechanical phase shifters each having an independent remotely controlled drive and being directly electrically connected to a respective antenna element of the plurality of antenna elements between a signal node and a feed node, the phase shifters being independently operable to vary the phase shift between the respective signal nodes and the feed node to thereby vary at least one of a beamwidth and an azimuth scan angle of a beam defined by the plurality of antenna elements.

24. A dynamically variable beamwidth and variable azimuth scanning antenna comprising:

a plurality of spaced-apart active radiating columns each including a dual dipole element, the plurality of radiating columns collectively defining both first and second beamwidths, as well as first and second azimuth scan angles corresponding to the respective first and second polarizations of the dual dipole elements, wherein the respective beamwidths and azimuth scan angles correlate to phase shifts between a feed node and each radiating column of the plurality of columns; and a plurality of continuously adjustable mechanical phase shifters each having an independent remotely controlled drive and being juxtaposed between a respective radiating column and the feed node, the phase shifters being independently operable to vary the phase shift between each respective radiating column of the plurality of radiating columns and the feed node to thereby vary the respective beamwidths and the respective azimuth scan angles defined by the plurality of active radiating columns.

25. The antenna of claim 24, wherein the first polarization is orthogonal to the second polarization.

26. The antenna of claim 24, wherein the phase shifter pair has a common drive.

27. The antenna of claim 24, wherein the dual dipole element angles inwardly.

28. The antenna of claim 24, further comprising a plurality of power dividers electrically connected to the plurality of spaced-apart active radiating columns, the power dividers being operable to vary the power levels between respective column signal nodes and the-feed node to thereby vary at least one of the beamwidth and the azimuth scan angles defined by the plurality of active radiating columns.

29. A dynamically variable beamwidth and variable azimuth scanning antenna comprising:

a plurality of spaced-apart active radiating columns each including a dual dipole element, the plurality of radiating columns collectively defining both first and second beamwidths, as well as first and second azimuth scan angles corresponding to the respective first and second polarizations of the dual dipole elements, wherein the respective beamwidths and azimuth scan angles correlate to phase shifts between a feed node and each radiating column of the plurality of columns; and a plurality of continuously adjustable mechanical phase shifters grouped in pairs, one pair per column, each phase shifter of a phase shifter pair having an independent remotely controlled drive and being juxtaposed between a respective radiating column and the feed node, the phase shifters being independently operable to vary the phase shift between each respective radiating column of the plurality of radiating columns and the feed node to thereby vary the respective azimuth scan angles defined by the plurality of active radiating columns.

30. The antenna of claim 29, wherein the first polarization is orthogonal to the second polarization.

31. The antenna of claim 29, wherein the phase shifter pair includes a common drive.

32. The antenna of claim 29, wherein the dual dipole element angles inwardly.

33. A dynamically variable beamwidth and variable azimuth scanning antenna comprising:

a plurality of spaced-apart active radiating columns each having a respective column signal node, the columns collectively defining a beam having a beamwidth and an azimuth scan angle correlated to phase shifts and power levels between the respective column signal nodes and a feed node;

a plurality of continuously adjustable mechanical phase shifters each having an independent remotely controlled drive and being directly electrically connected to a respective radiating column between the column signal node thereof and the feed node, the phase shifters being independently operable to vary the phase shift between the respective column signal nodes and the feed node to thereby vary at least one of the beamwidth and the azimuth scan angles defined by the plurality of active radiating columns; and a plurality of adjustable power dividers electrically connected to the plurality of spaced-apart active radiating columns, the power dividers being operable to vary the power levels between respective column signal nodes and the feed node to thereby vary at least one of the beamwidth and the azimuth scan angles defined by the plurality of active radiating columns.

34. The antenna of claim 33, wherein the power dividers are remotely adjustable.

35. The antenna of claim 33, wherein the plurality of power dividers are isolated.

36. The antenna of claim 33, wherein the plurality of power dividers are non-isolated.

37. The antenna of claim 33, wherein the plurality of radiating columns include a dual dipole element.

38. A method of dynamically varying the beamwidth of an antenna comprising:

exciting a plurality of spaced-apart active radiating columns at respective column signal nodes so that the columns collectively define a beam, wherein plurality of columns includes a dual polarized dipole element;

varying the phase of signals to the plurality of columns with a plurality of continuously adjustable mechanical phase shifters and defining a beamwidth with the phase shifts;

independently remotely controlling the phase shifters for the columns through respective independent remotely controlled drives of the phase shifters to independently vary the phase shifts between the respective column signal nodes and thereby vary the beamwidth of the beam.

39. A method of dynamically varying the beamwidth of an antenna comprising:

exciting a plurality of spaced-apart active radiating columns at respective column signal nodes, each including a dual dipole element, so that the columns collectively define both first and second beamwidths, as well as first and second azimuth scan angles, corresponding to the respective first and second polarizations of the dual dipole elements, wherein the respective beamwidths and azimuth scan angles correlate to phase shifts between as feed node and each radiating column of the plurality of columns;

varying the phase of signals to the plurality of columns with a plurality of continuously adjustable mechanical phase shifters to affect at least one of the respective beamwidths and azimuth scan angles with the phase shifts; and independently remotely controlling the phase shifters for the columns through respective independent remotely controlled drives of the phase shifters to independently vary the phase shifts between the respective column signal nodes.

40. The method of claim 39, further comprising orienting the first and second polarizations orthogonally.

41. The method of claim 39, further comprising electronically communicating with the antenna using signals, each signal associated with a respective independently controlled drive and used to actuate the drive, thereby adjusting the phase shifter, and varying the beamwidth of the antenna.

42. A method of dynamically varying the beamwidth of an antenna comprising:

exciting a plurality of spaced-apart active radiating columns at respective column signal nodes, each including a dual dipole element, so that the columns collectively define both first and second beamwidths corresponding to the respective first and second polarizations of the dual dipole elements, wherein the respective beamwidths correlate to phase shifts between as feed node and each radiating column of the plurality of columns;

varying the phase of signals to the plurality of columns with a plurality of continuously adjustable mechanical phase shifters to affect the respective beamwidths with the phase shifts; and independently remotely controlling the phase shifters for the columns through respective independent remotely controlled drives of the phase shifters to independently vary the phase shifts between the respective column signal nodes.

43. The method of claim 42, further comprising further defining at least one of the beamwidths and the azimuth scan angles by varying the power level of signals to the plurality of columns with a plurality of adjustable power dividers.

44. A method of dynamically varying the azimuth scanning angle of an antenna comprising:

exciting a plurality of spaced-apart active radiating columns at respective column signal nodes, each column including a dual dipole element, so that the columns collectively define both first and second beamwidths, as well as first and second azimuth scan angles, corresponding to the respective first and second polarizations of the dual dipole elements, wherein the respective azimuth scan angles correlate to phase shifts between as feed node and each radiating column of the plurality of columns;

varying the phase of signals to the plurality of columns with a plurality of continuously adjustable mechanical phase shifters to affect the respective azimuth scan angles with the phase shifts; and independently remotely controlling the phase shifters for the columns through respective independent remotely controlled drives of the phase shifters to independently vary the phase shifts between the respective column signal nodes.

45. The method of claim 44, further comprising further defining at least one of the beamwidths and the azimuth scan angles by varying the power level of signals to the plurality of columns with a plurality of adjustable power dividers.

46. A method of dynamically varying the beamwidth of an antenna comprising:

receiving a receive signal from a feed node in a receive port of a first power divider;

dividing the receive signal into first and second divided signals;

communicating the first divided signal via a first transmit port of the first power divider to a receive port of a second power divider;

communicating the second divided signal via a second transmit port of the first power divider to a receive port of a third power divider;

dividing the first divided signal at the second power divider into third and fourth divided signals;

communicating the third divided signal via a first transmit port of the second power divider to a receive port of a fourth power divider;

communicating the fourth divided signal via a second transmit port of the second power divider to a first antenna element of a plurality of antenna elements;

dividing the third divided signal at the fourth power divider into fifth and sixth divided signals;

communicating the fifth divided signal to a second antenna element of the plurality of antenna elements;

communicating the sixth divided signal to a third antenna element of the plurality of antenna elements;

dividing the second divided signal at the third power divider into seventh and eighth divided signals;

communicating the seventh divided signal via a first transmit port of the third power divider to a fourth antenna element of the plurality of antenna elements; and communicating the eighth divided signal via a second transmit port of the third power divider to a fifth antenna element of the plurality of antenna elements.

* * * * *

UNITED STATES PATENT AND TRADEMARK OFFICE

CERTIFICATE OF CORRECTION

PATENT NO. : 6,809,694 B2
DATED : March 27, 2003
INVENTOR(S) : Webb et al.

It is certified that error appears in the above-identified patent and that said Letters Patent is hereby corrected as shown below:

Column 2,
Line 31, reads "...is positioned so as to affect a respective polarization of the signal propagating from each column 28." and should read -- ...is positioned so as to effect a respective polarization of the signal propagating from each column 28. --.

Column 3,
Line 5, reads "As shown in FIG. 1 the dual dipole…" and should read -- As shown in FIG. 1, the dual dipole… --.
Line 7, reads "...elevation reed networks…" and should read -- ...elevation feed networks… --.
Line 67, reads "...as an inline phase…" and should read -- ...as an in-line phase… --.

Column 4,
Line 4, reads "As in known in the art,…" and should read -- As is known in the art,… --.

Column 7,
Line 19, reads "...indicated at by arrow 90." and should read -- …indicated by arrow 90. --.

Column 9,
Lines 35-37, reads "...provides particular utility in certain applications may use single radiating elements." and should read -- ...provides particular utility, certain applications may use single pole radiating elements. --.

Column 13,
Line 26, reads "...and the-feed node to thereby…" and should read -- ...and the feed node to thereby… --.

Column 14,
Lines 50-51, reads "...correlate to phase shifts between as feed node and each radiating column of the plurality of columns;…" and should read -- ...correlate to phase shifts between a feed node and each radiating column of the plurality of columns;… --.

UNITED STATES PATENT AND TRADEMARK OFFICE

CERTIFICATE OF CORRECTION

PATENT NO. : 6,809,694 B2
DATED : March 27, 2003
INVENTOR(S) : Webb et al.

It is certified that error appears in the above-identified patent and that said Letters Patent is hereby corrected as shown below:

Column 15,
Line 11, reads "...correlate to phase shifts between as feed node and each radiating column of the plurality of columns;…" and should read -- ...correlate to phase shifts between a feed node and each radiating column of the plurality of columns;… --.
Line 35, reads "...correlate to phase shifts between as feed node and each radiating column of the plurality of columns;…" and should read -- ...correlate to phase shifts between a feed node and each radiating column of the plurality of columns;… --.

Signed and Sealed this

Twenty-seventh Day of September, 2005

JON W. DUDAS
*Director of the United States Patent and Trademark Office*